US007752811B1

(12) United States Patent
Pavlansky

(10) Patent No.: US 7,752,811 B1
(45) Date of Patent: Jul. 13, 2010

(54) GUTTER INSERT DEVICE AND METHOD

(76) Inventor: Mark Pavlansky, 11831 NC Hwy. 268, Elkin, NC (US) 26621

( * ) Notice: Subject to any disclaimer, the term of this patent is extended or adjusted under 35 U.S.C. 154(b) by 125 days.

(21) Appl. No.: 11/698,272

(22) Filed: Jan. 26, 2007

(51) Int. Cl.
*E04D 13/00* (2006.01)

(52) U.S. Cl. ..... 52/12; 52/11; 210/474

(58) Field of Classification Search ..... 52/11, 52/12

See application file for complete search history.

(56) References Cited

U.S. PATENT DOCUMENTS

| | | | | |
|---|---|---|---|---|
| 3,855,132 | A * | 12/1974 | Dugan | 210/455 |
| 4,949,514 | A * | 8/1990 | Weller | 52/12 |
| 5,107,635 | A * | 4/1992 | Carpenter | 52/12 |
| 5,242,591 | A * | 9/1993 | Beechert et al. | 210/474 |
| 5,592,783 | A * | 1/1997 | Jones | 52/12 |
| 5,595,027 | A * | 1/1997 | Vail | 52/12 |
| 6,932,911 | B1 * | 8/2005 | Groth et al. | 210/747 |
| 7,208,081 | B2 * | 4/2007 | Jones | 210/162 |
| 2004/0006927 | A1 * | 1/2004 | Wickett | 52/12 |
| 2004/0232057 | A1 * | 11/2004 | Orozco et al. | 210/86 |
| 2005/0034376 | A1 * | 2/2005 | Pourdeyhimi et al. | 52/11 |
| 2005/0178072 | A1 * | 8/2005 | Olthoff | 52/12 |
| 2005/0247611 | A1 * | 11/2005 | Groth et al. | 210/162 |
| 2006/0037253 | A1 * | 2/2006 | Mozeika, III | 52/12 |
| 2006/0117672 | A1 * | 6/2006 | Kurple et al. | 52/12 |
| 2006/0230687 | A1 * | 10/2006 | Ealer, Sr. | 52/12 |
| 2009/0178366 | A1 * | 7/2009 | Konkey | 52/745.2 |

OTHER PUBLICATIONS http:www.crestfoam.com/multifacetednew.html, published by Crest Foam Industries entitled—Products-Multifaceted.

http://medicaldesign.com/materials/five_things-didnt/ published by Medical Design, entitled Five Things You Didn't Know Reticulated Polyurethane Foam Could Do.

http://machinedesign.com/articla/where-reticulated-polyurethane-foam-s-a-fit-0221 published by Machine Design.

* cited by examiner

*Primary Examiner*—Brian E Glessner
*Assistant Examiner*—Adriana Figueroa
(74) *Attorney, Agent, or Firm*—Robert W. Pitts

(57) ABSTRACT

A gutter insert device is shaped to fit within a gutter hollow channel. The insert is a foamed material and it will at least partially fill the gutter hollow channel to resist accumulation of leaves, sticks and other debris. A top later is formed of reticulated polyurethane foam to resist ultraviolet light and flame retardants. Stock foam raw material is cut so that it will expand to form an elongated insert base.

12 Claims, 6 Drawing Sheets

GUTTER INSERT DEVICE AND METHOD

BACKGROUND OF THE INVENTION

1. Field of the Invention

The present invention relates to a gutter insert device and to a method for lining a gutter with the device. More particularly, the present invention relates to a gutter insert device shaped to to fit the gutter hollow channel and formed of a foam, and to a method of using the insert device to substantially fill a gutter hollow channel to resist accumulation of leaves, sticks and other debris therein.

2. Description of the Prior Art

Gutters and downspouts are designed to carry rainfall water off a roof system in a manner that prevents water from penetrating the roof system and cause the water to be directed away from home or building in a planned manner.

Excess rainwater that is not properly carried away can cause the roof to rot, undesirable stains on the brickwork and masonry, the foundation of a home or building to erode and flooding at a lower level or basement of a home or building.

Over the years, property owners have installed metal and plastic screens on their gutters in an attempt to keep the leaves and debris out, however smaller debris can still enter and collect therein. Some cleaning has always been necessary, and the screens make cleaning the gutter significantly more difficult. Moreover, leaves, pine needles and other debris tend to collect on the screens leaving an unsightly mess and holding damaging moisture against roof decking and fascia.

Within the last several years, newer ideas have been developed to improve gutter performance, a number of which involve a complete seamless gutter system. Most of these utilize gravity and the surface tension properties of water to draw water into the gutter system while preventing most debris from entering the gutter system. Some of these systems work reasonably well, but often involve the alteration of the original roof design, in some instances an extremely costly solution.

A number of other commercial products are also available for screening or protecting rain gutters. These include CINCH Gutter Guards from Guttertop Solutions of Dayton, Ohio, Gutter TOPPER from GutterTopper LTD, of Amelia, Ohio, Gutter HELMET from American Metal Products of Dayton, Ohio, the HALLET Gutter Cutter from Hallet ENTERPRISES from Crawfordsville, Ind., THE WEDGE downspout screen from Avlis Products of Templeton, Calif., and FLO-FREE Gutter Inserts from D.C.I. Company of Clifton Heights, Pa.

Another recent development involves the use of foamed plastics to prevent debris build up. Some foamed plastics have exceptional water draining capabilities and the ability to deflect leaves and debris. These recent developments, for the most part, have not considered the negative long term effects of Ultra-Violet radiation from the sun which will break down the foamed plastics structure and cause product failure within six to eight months and to oxidize and disappear within 24 months.

Although the known devices have some utility for their intended purposes, a need still exists in the art for an improved gutter-protecting method and insert device for preventing leaves, debris and other materials from accumulating in gutters. In particular, there is a need for an improved gutter-protecting insert device which is easy to install, is long-lasting, and allows water to flow through while keeping the majority of the debris out.

SUMMARY OF THE INVENTION

The present invention is an insert device for placement in the rain gutter hollow channel and a process for installing the product. The device includes an insert base shaped to fit within the rain gutter hollow channel and formed of either polyurethane or polyolefin foam. A top layer engages and covers the top of the insert base and is formed of reticulated polyurethane foam or extruded polyethylene. The top layer is treated with a binding agent to extend product life and with ultraviolet resistive and flame retardant compositions. The foam base is formed in an expandable grid that results in savings in the use of polyurethane or polyolefin foam and increased water flow and ventilation within the hollow channel.

From the foregoing summary, it can be seen that a primary objective of the present invention is to provide an insert device for a gutter that will exceed the performance of all previously developed gutter systems.

Another objective of the present invention is to substantially eliminate rainwater problems in a roof system.

Yet another objective of the present invention is to provide an insert device for a gutter that will eliminate the need to ever replace original installed gutters on a house or building due to water exposure.

Still another objective is to provide a process for forming and installing the insert device' of the present invention

DETAILED DESCRIPTION OF THE INVENTION

Figure 1:
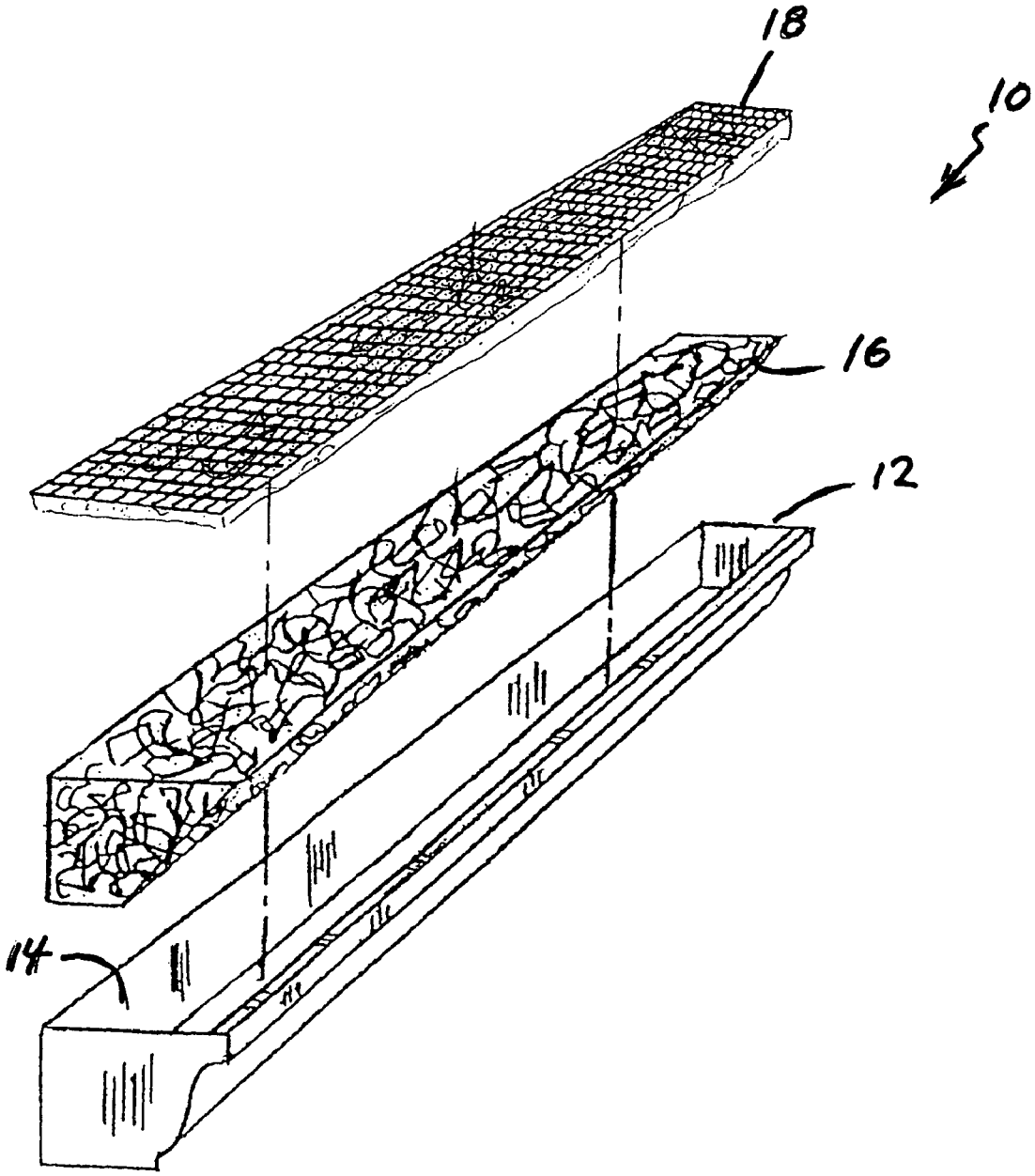
FIG. 1 is an exploded perspective view of a gutter insert base and top layer according to a first inventive embodiment of the invention.
Figure 2:
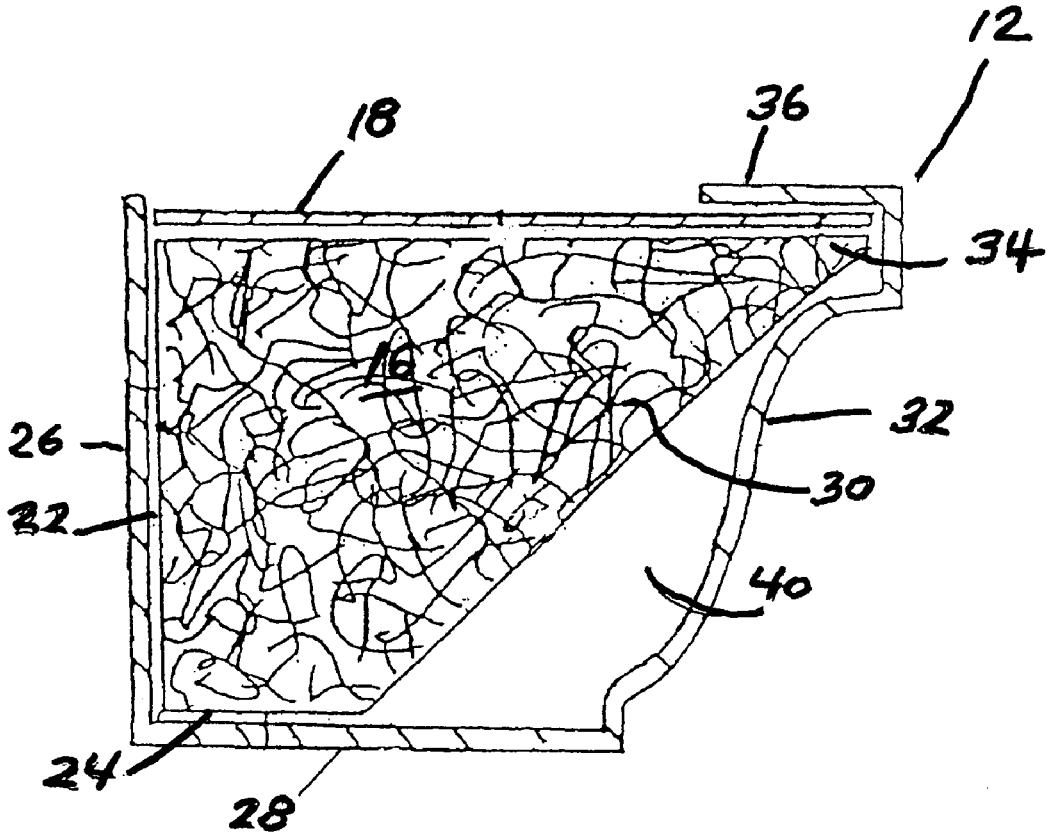
FIG. 2 is a cross-sectional view of the gutter fitted with the insert base and top layer of the present invention.
Figure 3:
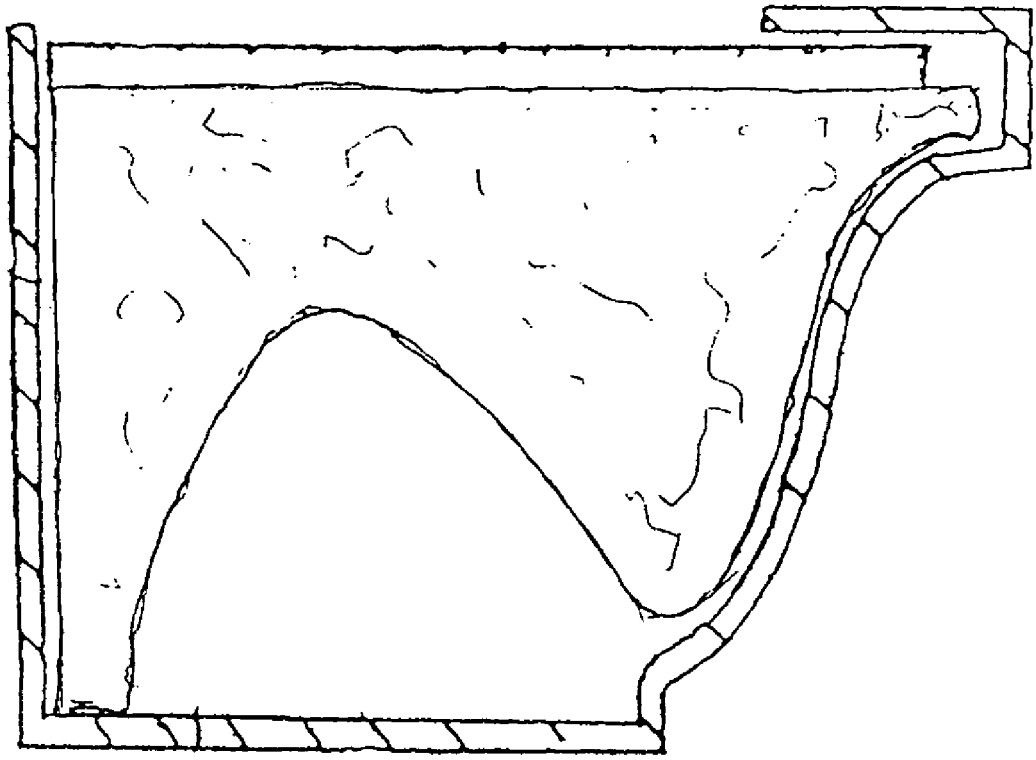
FIG. 3 is a transverse cross-sectional view of a gutter and insert device according to another illustrative embodiment of the invention.
Figure 4:
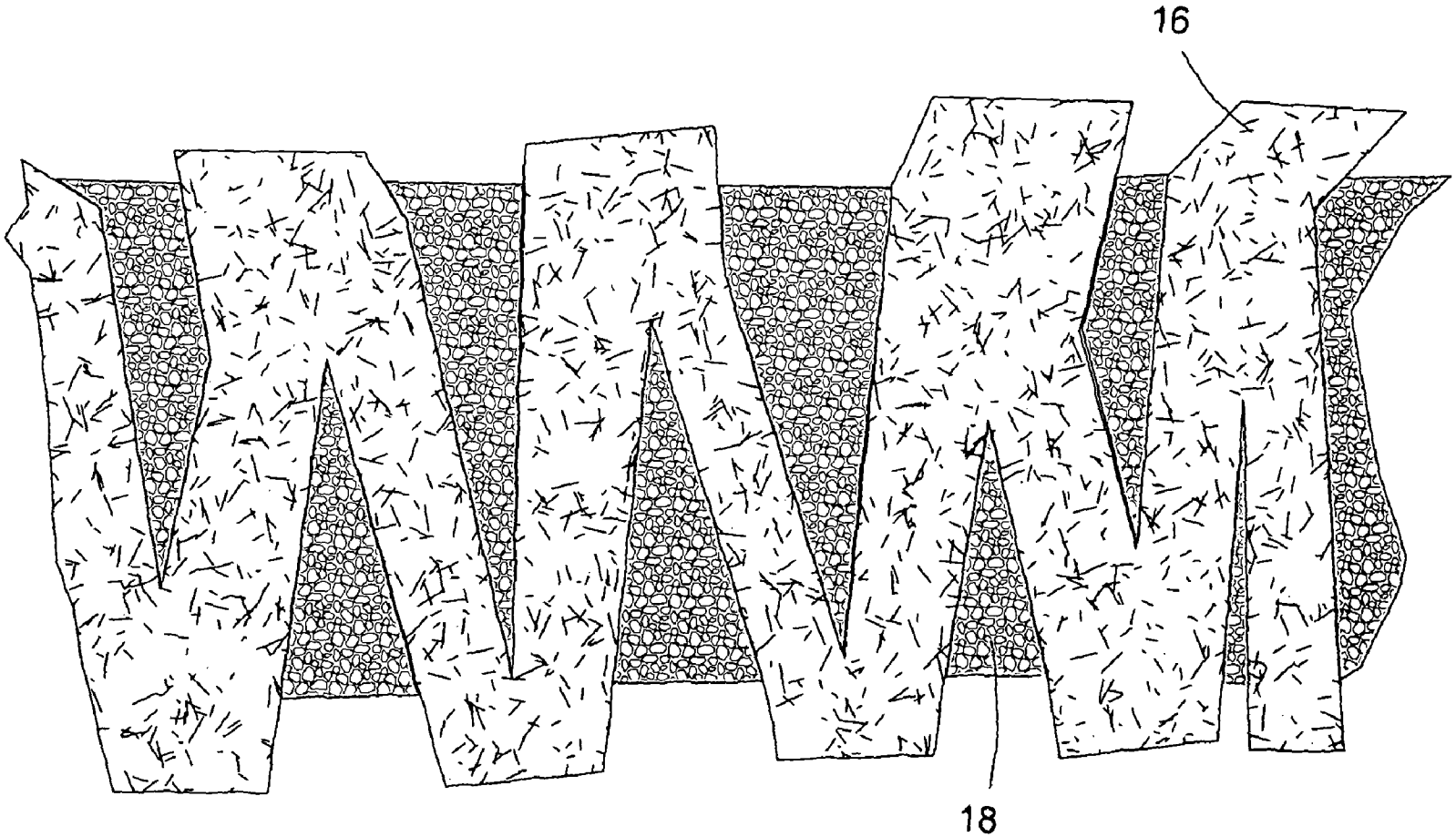
FIG. 4 is a bottom view of a segment of the insert device shown in FIG. 3.
Figure 5:
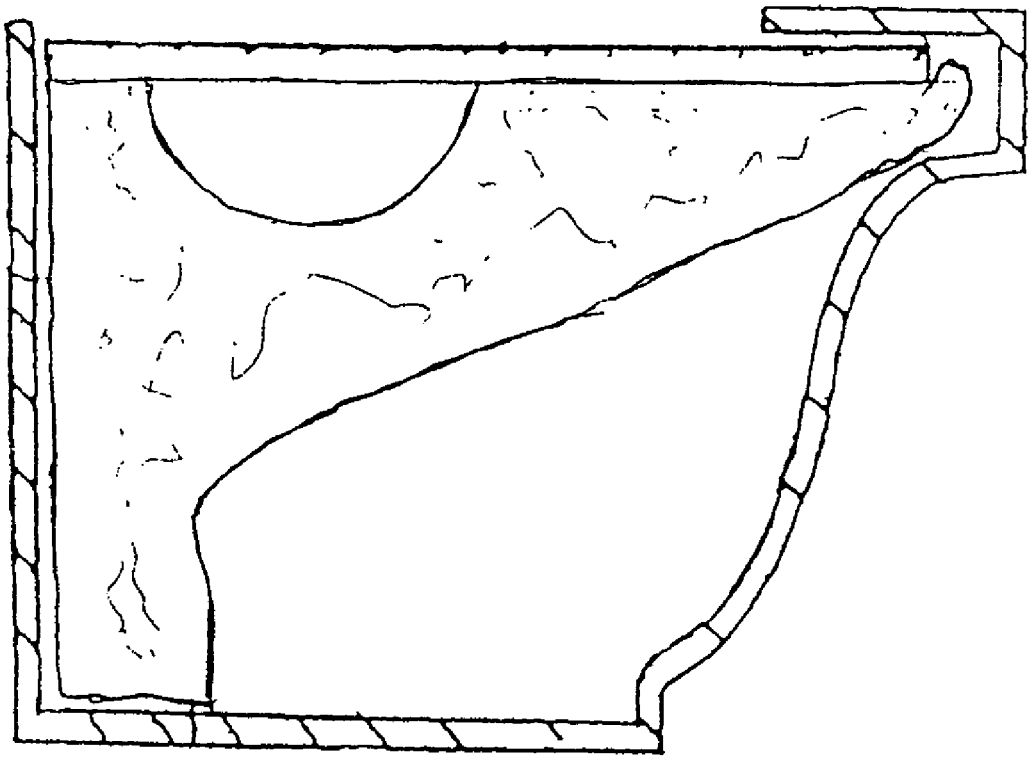
FIG. 5 is a transverse cross-sectional view of a gutter and insert device according to another illustrative embodiment of the invention.
Figure 6:
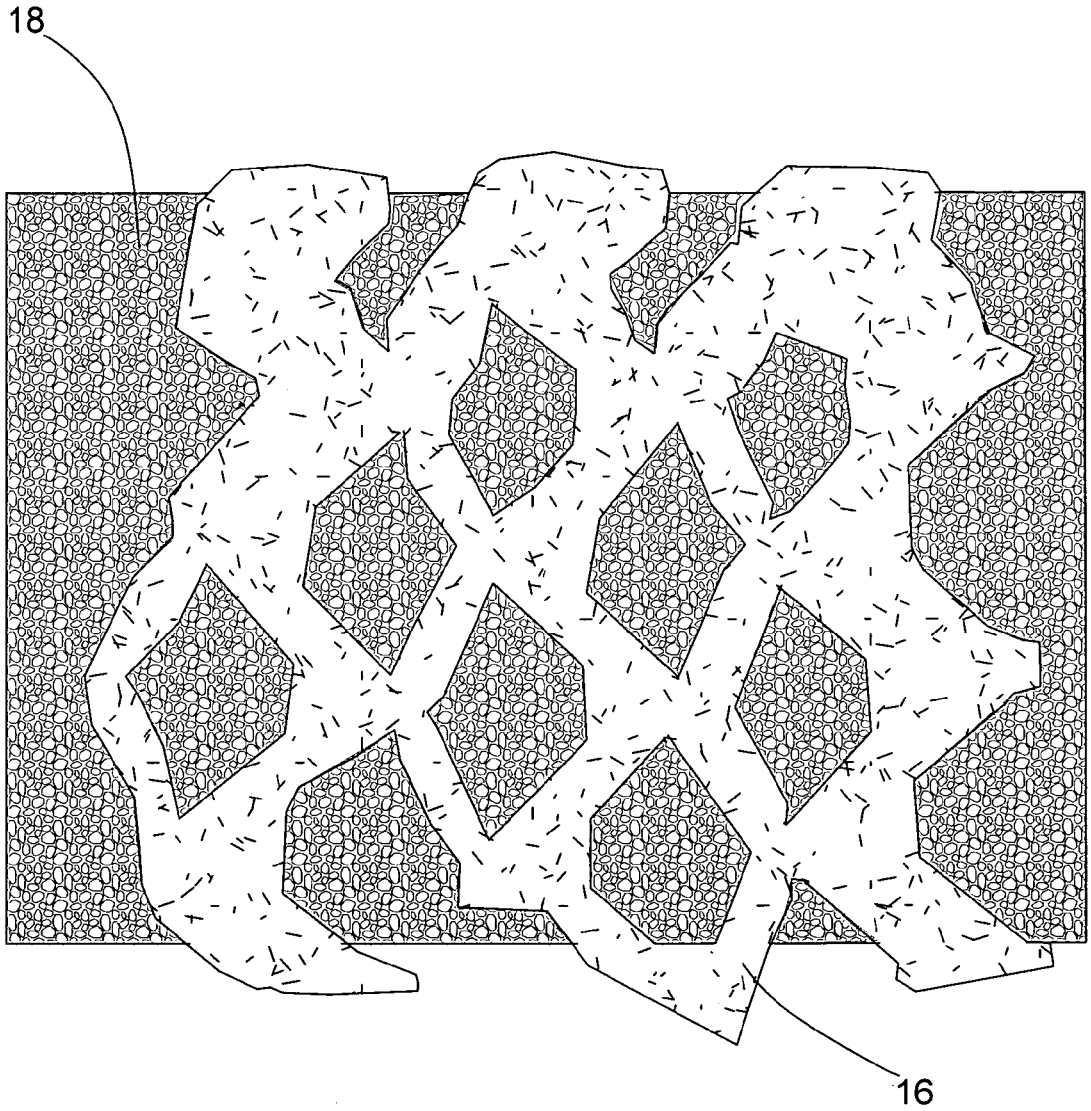
FIG. 6 is a bottom view of a segment of the insert device shown in FIG. 5.

The combination of different types of foamed plastics along with porous matting in a gutter system have been developed. Foamed plastics that can withstand the effects of Ultra-Violet radiation and the harmful effects of wet/dry cycles have been manufactured and successfully utilized as a form of gutter clog prevention. When a foamed plastic such as reticulated polyurethane is treated to withstand Ultra-Violet radiation from the sun and wet/dry cycles, this material will allow the efficient passage of water through it while blocking other unwanted materials that could clog a gutter. Similarly an extruded polyethylene fiber can be combined with a material of lesser value to create the best possible gutter protection. The material of lesser value gives proper support to the top porous layer and becomes one of the best solutions to prevent gutters from clogging at a cost that is considerably lower than other gutter guarding products. Referring now to the drawings and particularly to FIGS. 1 and 2, an insert device according to a first illustrative embodiment of the invention is shown generally at 10, along with a gutter 12 in, which the insert device fits. Insert device 10 is shaped to fit within an inside channel 14 of gutter 12.

In use, insert device 10 is placed inside of gutter channel 14 within gutter 12 as to substantially fill part of channel 14 and to block entry of debris into the gutter. When placed in channel 14, insert device 10 substantially prevents foreign matter such as leaves, twigs, pine, needles and other substances from collecting in the channel.

Insert device 10 includes an insert base 16 shaped to fit within gutter channel 14 and formed of either polyurethane or polyolefin foam. A top layer is engages and covers the top of insert base 16 and is formed of reticulated polyurethane foam or extruded polyethylene. Top layer 18 is treated with a binding agent to extend product life and with ultraviolet resistive and flame retardant compositions. Suitable representative binding agents include acrylic latex and phenolic latex. Foam base 16 is formed in an expandable grid that results in savings in the use of polyurethane or polyolefin foam and increased water flow and ventilation within channel 14.

Referring now to FIG. 2, when insert 10 according to the first embodiment of the invention is installed inside gutter 12, the insert substantially fills a back portion of gutter channel 14 with respective outer wall parts 22, 24, of insert 10 contacting the back wall 26 and floor 28 of channel 14. In addition, part of the outer wall 30 of insert base 16 rests on part of the outer gutter wall 32 and the outermost top edge 34 of insert base 16 fits engagingly below the upper, inwardly facing lip 36 of gutter 12 to retain insert base 16 in place in gutter 12. Insert base 16 is configured and dimensioned so that the lower part of front or outer wall 30 is spaced rearwardly away from outer wall 38 to provide a passage 40 on the outside of insert base 12 to allow water to flow freely through channel 14.

Additional embodiments of insert bases are shown in FIGS. 3-6. In each embodiment, insert base designs have been varied to conserve foam material and to maximize water flow and ventilation. Moreover, lengths of stock raw material may be cut automatically to achieve the expandable grids shown in FIGS. 4 and 6 thus making installation considerably easier. This automatic cutting is done using a steel ruled die in a hydraulic press to cut a specific pattern into the base. Such a die can also be mounted to a rotary press and added to the manufacturing process and be done in-line while the polyolefin base material is being extruded.

The present invention also encompasses a method of lining a gutter with an insert device comprising the steps of placing an elongated insert base into a gutter channel to contact the gutter on multiple sides of the base to fill part of the channel while leaving an open water flow passage in the channel outside of the insert device, and then placing an elongated top layer into the gutter channel against the insert base.

Although the present invention has been described herein with respect to a limited number of presently preferred embodiments, the foregoing description is intended to be illustrative and not restrictive. Those skilled in the art will realize that many modifications of the preferred embodiment can be made which would be operable. All such modifications, which are within the scope of the appended claims, are intended to be within the scope and spirit of the present invention.

I claim:

1. An insert device for use with a rain gutter having a hollow channel, the device comprising: an insert base shaped to fit within the rain gutter hollow channel for a substantial length of the gutter and formed of a polyolefin foam; and a top layer positioned above the insert base for substantially the length of the insert base and formed of a reticulated polyurethane foam that is porous so that water will flow through the foam forming the top layer, wherein the insert base includes a surface forming at least a portion of a passage through which water flows along the rain gutter, wherein the insert base supports the top layer and the insert base occupies a greater volume than the top layer formed from porous reticulated polyurethane foam, and wherein both the insert base and the top layer permit water flow in the gutter.

2. The device as claimed in claim 1 wherein the width of the top layer is substantially the width of the insert base.

3. The device as claimed in claim 1 wherein the top layer is treated with a binding agent to extend the life of the top layer.

4. The device as claimed in claim 2 wherein the top layer is treated with a binding agent to extend the life of the top layer.

5. The device as claimed in claim 3 wherein the binding agent is acrylic latex.

6. The device as claimed in claim 3 wherein the binding agent is phenolic latex.

7. The device as claimed in claim 1 wherein the top layer is treated with ultraviolet resistive and flame retardant compositions, and the top layer covers the insert base so that only the top layer is exposed and need be treated with the ultraviolet resistive composition.

8. The device as claimed in claim 1 wherein the polyolefin foam base is formed in an expanded grid, formed by cutting a polyolefin foam material and expanding and separating the cut polyolefin foam material to form the expanded grid, that results in savings in the use of the polyolefin foam material forming the expanded polyolefin foam base and increases water flow and ventilation within the hollow channel.

9. A gutter insert device for use in a rain gutter, wherein the gutter insert device includes a reticulated foamed plastic layer forming a top layer extending from end to end to form an entire upper surface of the gutter insert device, the gutter insert device being supportable in the rain gutter so that the reticulated foamed plastic layer covers the gutter, the reticulated foam top layer allowing rain water to flow through the foam and blocking solid debris, the reticulated foamed plastic top layer including ultraviolet resistive and flame retardant compositions, wherein a portion of the insert device below the reticulated foam layer is at least partially void to form an open flow passage to permit flow of water within and along the rain gutter, wherein a portion of the insert device, comprises an insert base formed of foam other than reticulated foam that supports the top layer and the insert base occupies a greater volume than the top layer formed from reticulated foam, and wherein both the insert base and the top layer permit water flow in the gutter.

10. The gutter insert device of claim 9 wherein the reticulated foamed plastic top layer includes ultraviolet resistive and flame retardant compositions, and the top layer covers the insert base so that only the top layer is exposed and need be treated with the ultraviolet resistive composition.

11. The gutter insert device of claim 10 wherein the foam base layer is formed of a polyolefin foam and the reticulated foamed plastic top layer is formed of a reticulated polyurethane foam.

12. The gutter insert device of claim 9 wherein the foam base layer comprises an extruded foam cut to form an expandable grid in which gaps are formed by cutting the extruded foam.

* * * * *